US007726631B2

(12) United States Patent
Noe et al.

(10) Patent No.: US 7,726,631 B2
(45) Date of Patent: Jun. 1, 2010

(54) DISPOSER INSTALLATION TOOL

(76) Inventors: Valerie C. Noe, 2112 Matagorda Dr., Portland, TX (US) 78374; Raymond G. Mendez, Jr., 613 Green St., Taft, TX (US) 78390

( * ) Notice: Subject to any disclaimer, the term of this patent is extended or adjusted under 35 U.S.C. 154(b) by 0 days.

(21) Appl. No.: 12/317,738

(22) Filed: Dec. 29, 2008

(65) Prior Publication Data

US 2009/0166596 A1 Jul. 2, 2009

Related U.S. Application Data

(60) Provisional application No. 61/009,571, filed on Dec. 31, 2007.

(51) Int. Cl.

| | |
|---|---|
| ***B66F 3/36*** | (2006.01) |
| ***B66F 3/08*** | (2006.01) |
| ***B23Q 3/18*** | (2006.01) |
| ***B23Q 3/00*** | (2006.01) |

(52) U.S. Cl. ..... 254/100; 254/13; 254/DIG. 1; 269/60; 269/289 R; 269/902

(58) Field of Classification Search ..... 254/100, 254/98, 134, 13, 85, DIG. 4, DIG. 2, DIG. 8, 254/DIG. 1; 269/60; 29/266, 256, 271, 464; 241/46.014, 46.013

See application file for complete search history.

(56) References Cited

U.S. PATENT DOCUMENTS

| | | | | |
|---|---|---|---|---|
| 3,222,030 | A * | 12/1965 | Thorpe | 254/100 |
| D338,310 | S * | 8/1993 | Clarke | D34/31 |
| H1823 | H | 12/1999 | Wolford | |
| 6,142,460 | A * | 11/2000 | Irwin | 269/60 |
| 6,581,911 | B1 * | 6/2003 | Scott | 254/100 |
| 7,024,743 | B2 | 4/2006 | Heaton | |
| 7,140,086 | B2 | 11/2006 | Heaton | |
| 7,401,392 | B1 * | 7/2008 | Ramsey | 29/252 |
| 7,458,141 | B2 * | 12/2008 | Goldburt et al. | 29/464 |
| 2006/0065881 | A1 | 3/2006 | Walton | |

* cited by examiner

*Primary Examiner*—Joseph J Hail, III
*Assistant Examiner*—Jamal Daniel

(57) ABSTRACT

A tool is used to elevate and hold a garbage disposer against a sink fixture during removal and/or installation of a garbage disposer. The tool includes a flat base including a notch opening through a corner of a rectilinear base to allow an electric cord to pass around the tool. A flat load supporting platform includes a similar notch. A screw jack force applying mechanism allows the platform to be raised relative to the base. The tool works equally well with the base down or with the platform down so the user doesn't have to turn the tool over for it to work.

9 Claims, 2 Drawing Sheets

DISPOSER INSTALLATION TOOL

This application is based on Provisional Patent Application Ser. No. 61/009,571 filed Dec. 31, 2007, on which priority is claimed.

This invention relates to a tool for elevating, lowering and/or holding a disposer while in the process of removing or connecting it to a drain fixture under a sink.

BACKGROUND OF THE INVENTION

One of the ubiquitous appliances in modern American homes is known as a disposer which is mounted under a kitchen sink to grind foods put down the sink into pieces which can be handled by conventional municipal sewers and/or septic tanks. Disposers are suspended from a drain fixture extending downwardly from the sink. Installation and removal of disposers have their problems because of the weight of the disposers and because they are suspended from the drain fixture, meaning the disposer must be lifted during installation or lowered during removal. Current model disposers weigh from 13-20 pounds. Installation technicians have some difficulty holding the disposer off the floor of the underlying sink cabinet while attempting to either attach or detach the disposer from the sink fixture. Complicating the removal and/or installation of disposers is the cramped cabinet where the disposer is located. The installation technician ends up lying on his back where his shoulders are inside the cabinet with his lower back at a lower elevation on the kitchen floor.

It is accordingly not surprising that devices have been proposed in the prior art to assist in removing and/or installing garbage disposers as shown in U.S. Pat. Nos. 6,142,460; 7,024,743 and 7,140,086 and Printed Patent Application 2006/0065881. Other disclosures of interest relative to this invention are found in U.S. Pat. No. 3,222,030 and Statutory Invention Registration H1823.

SUMMARY OF THE INVENTION

While the prior art disposer installation devices are eminently suitable for their purpose, improvements have been made to provide a simple lightweight inexpensive disposer installation tool having the capability of contending with an electrical power cord leading to the disposer and having the capability of working equally well with either end up. This latter ability avoids the situation where the installer, on his back, positions an installation tool under the disposer and later realizes it is upside down. In other words, there is no upside down with the installation tool of this invention.

The installation tool comprises a base, a load platform and a screw jack mechanism for safely raising and lowering the load platform relative to the base. Both the base and the load platform are relatively flat and include at least one notch opening through a side of the base and platform to accommodate the power cord leading to the disposer. The screw jack mechanism includes a tube inserted into a passage in the base, a section of all-thread having a nut thereon and a nut in a blind passage of the load platform. The screw jack mechanism is designed to be operable by an individual of modest strength without the use of wrenches, levers or other mechanical advantage providing devices.

It is an object of this invention to provide an improved installation tool for use while removing or connecting it to a drain fixture under a sink.

A further object of this invention is to provide an improved device of this type which can be manipulated by hand without the need for a wrench.

A more specific object of this invention is to provide an apparatus of this type which operates equally well with either end up.

These and other objects and advantages of this invention will become more apparent as this description proceeds, reference being made to the accompanying drawings and appended claims.

DETAILED DESCRIPTION

Figure 1:
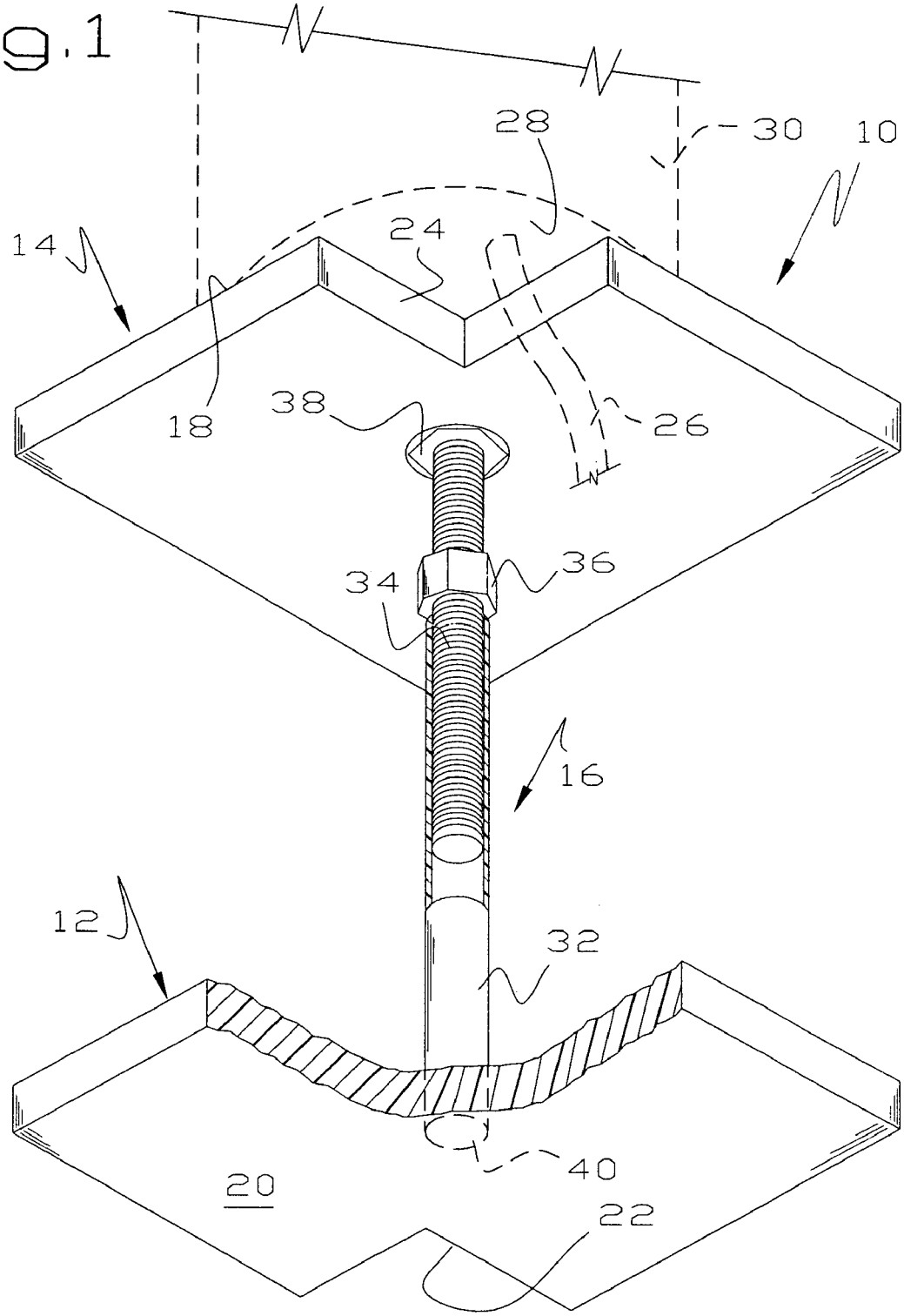
FIG. 1 is a broken isometric view of a disposer installation tool illustrating one end up.
Figure 2:
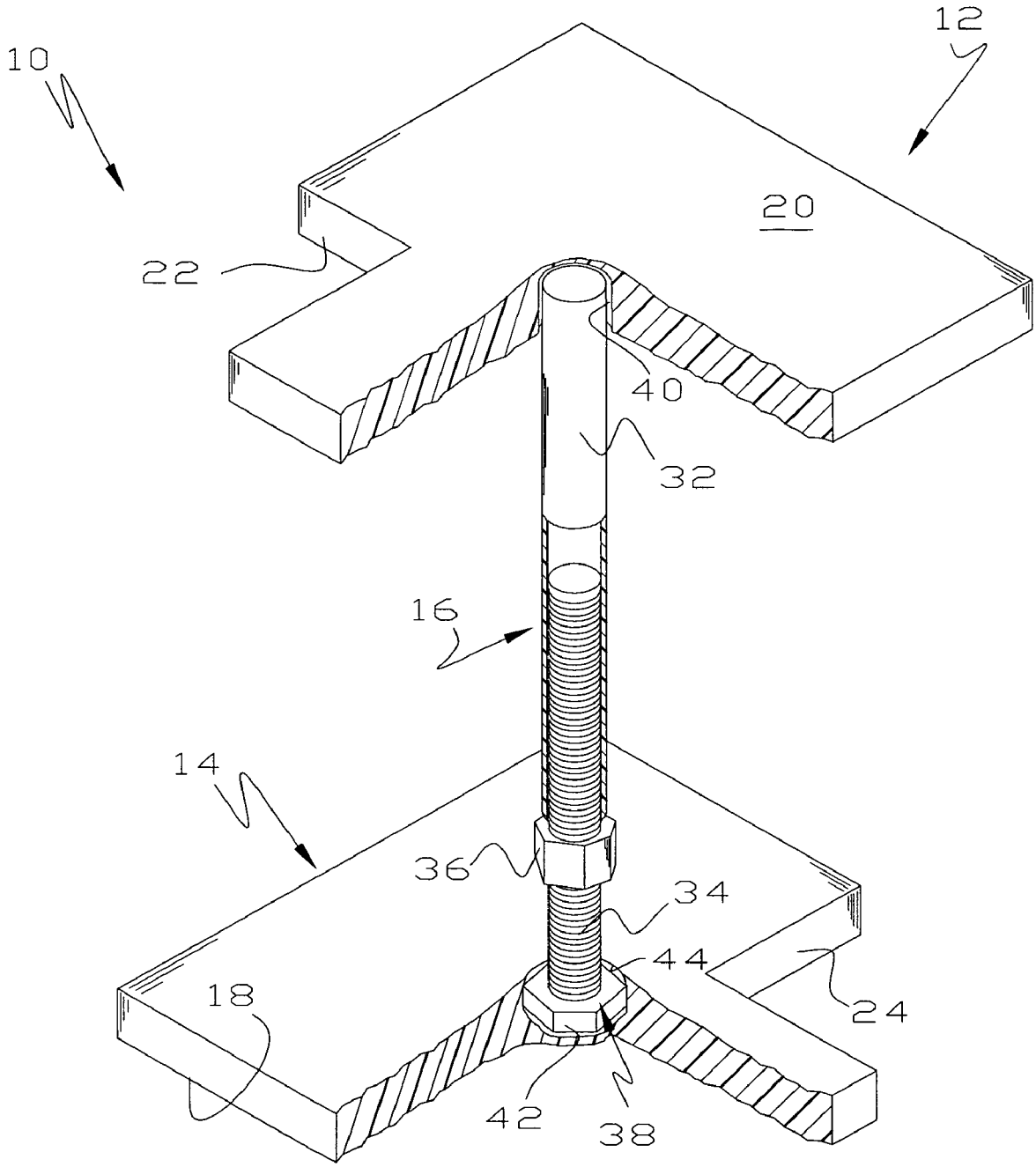
FIG. 2 is a broken isometric view of the disposer installation tool of FIG. 1 illustrating the opposite end up.

Referring to FIGS. 1-2, a disposer installation tool 10 comprises, as major components, a base 12, a load supporting platform 14 and a screw jack mechanism 16 for raising and lowering the platform 14 relative to the base 12 in a safe, simple and expeditious manner.

In some embodiments, the base 12 and load supporting platform 14 are mainly identical and are made of any suitable material, conveniently a polyvinyl chloride. The load bearing surface 18 of the base 12 and the load bearing surface 20 of the platform 14 are flat or planar and thus are able to function interchangeably. By flat or planar, it is meant there are no substantial projections from the base 12 or platform 14 toward a load or support. This allows the disposer installation tool 10 to be used with either end up and accommodate any bottom configuration of a disposer without a great deal of unnecessary manufacturing steps. In practice, the base 12 and platform 14 may be made in any suitable manner, as by sawing a plank or panel into sections of the correct size and shape.

In some embodiments, the base 12 and platform 14 are square or rectangular. The base 12 and platform 14 include at least one notch 22, 24 opening through a side or preferably a corner in the case of polygonal members. One problem with disposer installation tools is accommodating power cords leading to the disposer. In some disposers, the power cord exits from a side of the disposer and, in some disposers, the power cord 26 exits from the bottom 28 of the disposer 30 as suggested in dashed lines in FIG. 1. In order to accommodate all situations, the notches 22, 24 are provided as will become more fully apparent hereinafter.

The screw jack mechanism 16 includes an unthreaded tube 32, a section of all-thread 34, a nut 36 threadably received on the all-thread 24 and means 38 for attaching the all-thread to the base 12. The tube 32 is removably inserted or frictionally fit into a blind passage 40 adjacent the center of the base 12. The all-thread 34 and tube 32 are sized so the all-thread fits closely inside the tube 32. It will be seen that, given a tube 32 and all-thread 34 of predetermined length, the overall height of the tool 10 is limited. An inexpensive technique allowing for an increased height is to provide a second tube of the same diameter but slightly longer. This is preferred to providing a longer all-thread.

In some embodiments, the nut 36 has a simple polygonal exterior free of mechanical advantage devices such as levers, wings and the like. In some embodiments, the nut 36 is sufficiently large to allow a person of modest strength to turn the nut 36 on the all-thread 34 against a load of at least twenty pounds which is in excess of the weight of current commercially available residential disposers. In practice, a ¾" O.D. all-thread 34 with a hex nut measuring 1.1" across the flats of the nut has proved suitable for raising and lowering twenty pound disposers without requiring a wrench.

Although the all-thread 34 could be permanently affixed to the platform 14, it is preferred that the means 38 include a nut 42 adhesively secured a blind passage 44 and threadably receiving the all-thread 34. Putting the nut 42 in the blind passage 44 allows immediate packing of the tool 10 because the nut 42 cannot be displaced from its location in the blind passage 44. The ability to remove the tube 32 and detach the all-thread 34 from the nut 42 means that the disposer installation tool 10 may be laid flat to be stored and shipped in a small container.

Use of the disposer installation tool 10 should now be apparent. To remove an existing disposer, the installer inserts the tool 10, either with the platform 14 up as in FIG. 1 or with the base 12 up as in FIG. 2, under the existing disposer. If the disposer has a power cord with a bottom exit, the platform 14 is rotated until the power cord passes through the notch 22. The nut 36 is grasped and rotated. With the platform 14 up as in FIG. 1, the nut 36 bears against the top of the tube 32 thereby raising the platform 14. With the base 12 up as in FIG. 2, the nut 36 bears against the bottom of the tube 32 thereby raising the base 12. When the platform 14 is elevated securely against the bottom of the existing disposer, the disposer is detached from its support on the bottom of the drain fixture and may be lowered, if desired, by turning the nut 36 in the opposite direction.

To install a new disposer, the tool 10 is placed under the sink where the disposer is to be attached and the disposer is placed on the platform 14 or on the base 12, depending on which is up. The power cord is draped through the notch 22 and the nut 36 is rotated to elevate the disposer to a position where it approaches its connection to the drain fixture and is then attached to it. The nut 36 is rotated in the opposite direction to lower the platform 14 so it may be removed.

It will be apparent that the disposer installation tool 10 of this invention works equally well with the platform 14 on an underlying support surface with the disposer supported on the base 12. When the platform 14 is up, as in FIG. 1, the bottom of the nut 36 pushes on the top of the tube 16 and, when the platform 12 is up, as in FIG. 2, the same side of the nut 36 pushes on the same shoulder of the tube 16. In other words, when the platform 14 carries the load of the disposer 30, the screw jack mechanism 16 provides a first mechanical advantage and when the base 12 carries the load of a disposer of equal weight, the screw jack mechanism 16 provides an equal mechanical advantage.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A disposer installation tool comprising a base having a flat load bearing surface having at least one notch communicating with a side of the base to receive wiring leading from the disposer when the base engages a disposer, a flat load supporting platform having a load bearing surface having at least one notch communicating with a side of the platform to receive wiring leading from the disposer when the platform engages the disposer whereby the base and load supporting platform operate with either one engaging the disposer and the other one engaging an underlying surface, and a screw jack mechanism for moving the base and platform relative to each other including a tube extending perpendicular to the base and providing a free end having an abutment, a threaded rod connected to the load supporting platform adjacent a center thereof, and a nut, on the threaded rod, abutting the abutment of the tube so that rotation of the nut bears against the tube and moves the platform relative to the base, the installation tool being operative with the base being supported by an underlying surface and a load on the platform and with the platform being supported by an underlying surface and a load on the base.

2. The disposer installation tool of claim 1 wherein the platform comprises a blind passage adjacent the center thereof, a second nut in the blind passage and affixed to the platform, the threaded rod being threaded into the second nut and extending perpendicularly from the platform.

3. The disposer installation tool of claim 2 wherein the second nut is adhesively affixed to the platform.

4. The disposer installation tool of claim 2 wherein the base provides a passage near a center of the base and the tube is inserted into the passage.

5. The disposer installation tool of claim 4 wherein the passage is a blind passage and wherein the tube is friction fit in the blind passage provided by the base so the tube and threaded rod may be removed from the base and the platform to lie flat during shipment.

6. The disposer installation tool of claim 1 wherein the nut provides an exterior of polygonal configuration free of lever extensions and of a size to be manually turned against a load of twenty pounds on the platform.

7. The disposer installation tool of claim 1 wherein the base and platform are of rectilinear configuration and the notch opens through a corner.

8. The disposer installation tool of claim 1 wherein the screw jack mechanism provides a first mechanical advantage when the load supporting platform carries a disposer and a second equal mechanical advantage when the base carries a disposer of equal weight.

9. The disposer installation tool of claim 1 wherein the flat load bearing surface of the base being free of projections extending therefrom and the load bearing surface of the platform being free of projections extending therefrom.

* * * * *